US008720341B2

(12) United States Patent
Brunn

(10) Patent No.: US 8,720,341 B2
(45) **Date of Patent: *May 13, 2014**

(54) MULTIPLE OUTPUT AND EFFECT GRENADE

(71) Applicant: Michael Brunn, Sea Cliff, NY (US)

(72) Inventor: Michael Brunn, Sea Cliff, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/744,021

(22) Filed: Jan. 17, 2013

(65) Prior Publication Data

US 2013/0125773 A1 May 23, 2013

Related U.S. Application Data

(63) Continuation of application No. 13/076,948, filed on Mar. 31, 2011, now Pat. No. 8,365,668.

(51) Int. Cl.
*F42B 10/00* (2006.01)
*F42B 27/00* (2006.01)

(52) U.S. Cl.
CPC ..... *F42B 27/00* (2013.01)
USPC ..... 102/364; 102/482; 102/498

(58) Field of Classification Search
USPC ..... 102/334, 364, 365, 498, 445, 482
See application file for complete search history.

(56) References Cited

U.S. PATENT DOCUMENTS

| | | | | |
|---|---|---|---|---|
| 3,732,821 | A | 5/1973 | Royer | |
| 5,069,134 | A | 12/1991 | Pinkey | |
| 5,074,218 | A | 12/1991 | Castro | |
| 5,129,325 | A | 7/1992 | Matzagg | |
| 5,654,523 | A | 8/1997 | Brunn | |
| 5,698,812 | A | 12/1997 | Song | |
| 6,349,650 | B1 | 2/2002 | Brunn et al. | |
| 6,543,364 | B2 | 4/2003 | Wes et al. | |
| 6,767,108 | B1 | 7/2004 | Blachowski et al. | |
| 7,191,708 | B2 | 3/2007 | Ouliarin | |
| 7,293,492 | B2 | 11/2007 | Brunn | |
| 7,354,271 | B2 | 4/2008 | Brunn | |
| 7,387,073 | B2 | 6/2008 | Bodley et al. | |
| 7,908,972 | B2 | 3/2011 | Brunn | |
| 7,963,227 | B1 | 6/2011 | Brunn | |
| 8,113,689 | B2 | 2/2012 | Mayo et al. | |
| 8,113,838 | B2 | 2/2012 | Tran | |
| 8,117,966 | B1 | 2/2012 | Graber | |
| 8,161,883 | B1 | 4/2012 | Harasts et al. | |
| 8,365,668 | B2 * | 2/2013 | Brunn | 102/364 |
| 2005/0084827 | A1 | 4/2005 | Brunn | |
| 2012/0247359 | A1 * | 10/2012 | Brunn | 102/334 |
| 2013/0125773 | A1 * | 5/2013 | Brunn | 102/334 |

OTHER PUBLICATIONS

Nico Pyrotechnik Sales Brochure (Date Unknown).

* cited by examiner

*Primary Examiner* — Michael David
(74) *Attorney, Agent, or Firm* — Robert P. Michal; Lucas & Mercanti LLP

(57) ABSTRACT

A multiple output and effect grenade is provided, in which an exothermic delay column is utilized to initiate a series of primers via the application of heat to the strike faces thereof, thereby providing a reliable and relatively safe grenade to ship and store. In particular, a multiple output and effect grenade comprised of an exothermic delay column disposed within a central cavity, operable to initiate a series of primers disposed in primer cavities located within the main body of the grenade. The primer cavities may be arranged in a symmetrical or asymmetrical configuration, so as to produce a firing signature resembling an automatic weapon or random gunfire, respectively. In addition, effect charges, such as illuminants, sound agents, chemical irritants, etc., may be disposed within the primer cavities, as desired by the user.

20 Claims, 12 Drawing Sheets

MULTIPLE OUTPUT AND EFFECT GRENADE

CROSS-REFERENCE TO RELATED APPLICATIONS

This is a Continuation of U.S. patent application Ser. No. 13/076,948, filed Mar. 31, 2012, the entire disclosure of which is incorporated herein by reference.

BACKGROUND OF THE INVENTION

1. Field of the Invention

A multiple output and effect grenade is provided, in which an exothermic delay column is utilized to initiate a series of primers via the application of heat to the strike faces thereof. In particular, a multiple output and effect grenade comprised of an exothermic delay column operable to initiate a series of primers disposed in primer cavities within the main body of the grenade, so as to produce a desired firing signature, as well as initiate effect charges disposed within the primer cavities.

2. Description of the Related Art

The prior art is replete with numerous examples of various explosive non-lethal devices such as hand grenades, stun grenades, and the like, which have been utilized to train law enforcement and military personnel over the years, and utilized to control personnel with non-lethal/less than lethal force. For example, in U.S. Pat. No. 3,194,161 discloses a practice grenade and which is characterized by at least two shell segments which are articulated on a cap and are held in an assembled fashion so as to form a shell by a safety pin. The shell segments are urged to an opened or spreaded condition by spring means which upon removal of the pin become operative to spread the shell segments.

The practice grenade carries an ignitable material and all parts with the exception of the cap adjusting spring and certain parts of the igniter can be made out of plastic. In U.S. Pat. No. 3,369,486, a training hand grenade is described and which has a body which is made out of a soft spongy material so as to be harmless to a person hit by the device, and further has a combustible cartridge to provide an indicating flash when the cartridge is detonated within the soft spongy pliable body material.

U.S. Pat. No. 3,492,945 relates to a practice hand grenade and more specifically to a practice grenade which produces an amount of noise, flash and smoke and which also projects droplets of marker dye in a predetermined pattern so as to permit scoring during training exercises. In this invention, this training device further has a character by which it may be reloaded with dye and pyrotechnic and propellant charges for repeated usage.

U.S. Pat. No. 4,932,328 relates to a reloadable stun grenade, and more specifically to a stun grenade that minimizes the possibility of accidental injury by directing the force of the explosion which is detonated within the grenade out through the ends of the grenade rather than through the sides.

U.S. Pat. No. 5,654,523 describes an invention invented by the present inventor, which relates to a stun grenade including a plurality of vents which are defined in the housing and wherein each of the vents is angularly offset from the longitudinal axes of the cavity for discharging explosive energy radially outwardly from the grenade. The stun grenade also includes a bore for receiving a replaceable explosive charge.

U.S. Pat. No. 6,065,404 relates to a training grenade for a multiple integrated laser engagement system (MILES).

U.S. Pat. No. 7,387,073 relates to an explosive training device, capable of producing sound and visibly discernable light, and reloaded and reused.

While these devices noted above, and others, have operated with various degrees of success, they are unable to provide/employ varying signatures and effects in a single device in a controllable manner. Further, such conventional devices require a firing mechanism to initiate each effect, which makes production thereof expensive, and the device reliable only to the extent of the reliability of the firing mechanism. Further, scalability of effects is limited, and shipping and storage thereof are difficult and hazardous due to the firing mechanisms.

Accordingly, it is an object of the present invention to provide a grenade requiring no firing mechanism for each individual effect, thereby increasing the reliability and decreasing the expense of manufacture. In addition, it is an object of the present invention to provide a grenade which allows scalability of effects through the placement, quantity and type of effects therein. In particular, it is object of the present invention to provide a multiple output and effect grenade operable to be configured to deploy a plurality of outputs and effects in a controllable manner.

SUMMARY OF THE INVENTION

In order to achieve the objects of the present invention as mentioned above, the present inventor earnestly endeavored to develop a multiple output and effect grenade operable to be configured to deploy a plurality of outputs and effects in a controllable manner. Accordingly, in a first embodiment of the present invention, a multiple output and effect grenade is provided, comprising:

(a) a main body having a first end, a second end opposite the first end, an outer circumference therebetween, and a main cavity disposed within the main body between the first end and the second end;

(b) an exothermic delay column disposed within the main cavity, said delay column having a first end, a second end opposite the first end, and a middle portion therebetween;

(c) a plurality of primer cavities disposed within the main body, extending from the outer circumference to the main cavity so as to define an internal orifice in communication with the main cavity, and an output orifice within the outer circumference; and (d) at least one primer disposed within at least one of the primer cavities, a strike face of the primer being in communication with and/or adjacent to the delay column adjacent the internal orifice of the primer cavity, wherein the exothermic delay column is operable to initiate the primers in a controlled manner via the application of heat thereto.

In a second embodiment of the present invention, the multiple output and effect grenade of the first embodiment above is provided, wherein the delay column is preferably comprised of one or more fuze cords. In an alternative preferred embodiment, the delay column is comprised of one or more combustible compositions operable to burn from about the first end to about the second end of the delay column.

In a third embodiment of the present invention, the multiple output and effect grenade of the first embodiment is provided, further comprising one or more effect agents selected from illuminant compositions, chemical irritant agents, report (sound) agents, smoke agents and/or marking agents, disposed within one or more of the primer cavities, wherein the delay column is operable to initiate the one or more effect agents via initiation of the one or more primers.

In a fourth embodiment of the present invention, the multiple output and effect grenade of the first embodiment above is provided, further comprising an ignition charge disposed within the main cavity, adjacent the first end of the delay column, said ignition charge operable to ensure ignition of the delay column at or adjacent the first end thereof.

In a fifth embodiment of the present invention, the multiple output and effect grenade of the first embodiment above is provided, further comprising a booster charge disposed within one or more of the primer cavities, adjacent the strike face of the primers, wherein the booster charge is operable to ensure ignition of the delay column adjacent the first end thereof.

In a sixth embodiment of the present invention, the multiple output and effect grenade of the first embodiment above is provided, further comprising a transfer cavity disposed between the main cavity and one or more of the primer cavities.

In a seventh embodiment of the present invention, the multiple output and effect grenade of the first embodiment above is provided, further comprising one or more covering materials disposed on the outer circumference of the main body, adjacent the output orifice of one or more of the primer cavities, the one or more covering materials operable to secure the primer cavities from the environment. In addition to the covering materials, or as an alternative therefor, a U-formed closure means may be provided within the primer cavities to secure the primer cavities from the environment.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only, and are not restrictive of the invention as claimed.

BRIEF DESCRIPTION OF THE SEVERAL VIEWS OF THE DRAWING

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Commercial primers have evolved over the years to provide inexpensive, extremely reliable and safe functionality over a wide range of operational environments. The present inventor, realizing the advantages in safety and stability with regards to shipping and storing such primers, unexpectedly discovered that by utilizing the application of heat instead of percussion to the strike face of the primer, a safe, effective multiple output and effect grenade could be provided. Importantly, the grenade of the present invention requires no firing mechanism for each individual primer, making the grenade herein reliable and inexpensive to manufacture while allowing scalability of effects through the placement, quantity and type of primers used, and by changing the delay characteristics of the column. Specifically, the primer type, quantity and placement affect the output intensity, while the placement and delay time affect the rate of fire.

Figure 1:
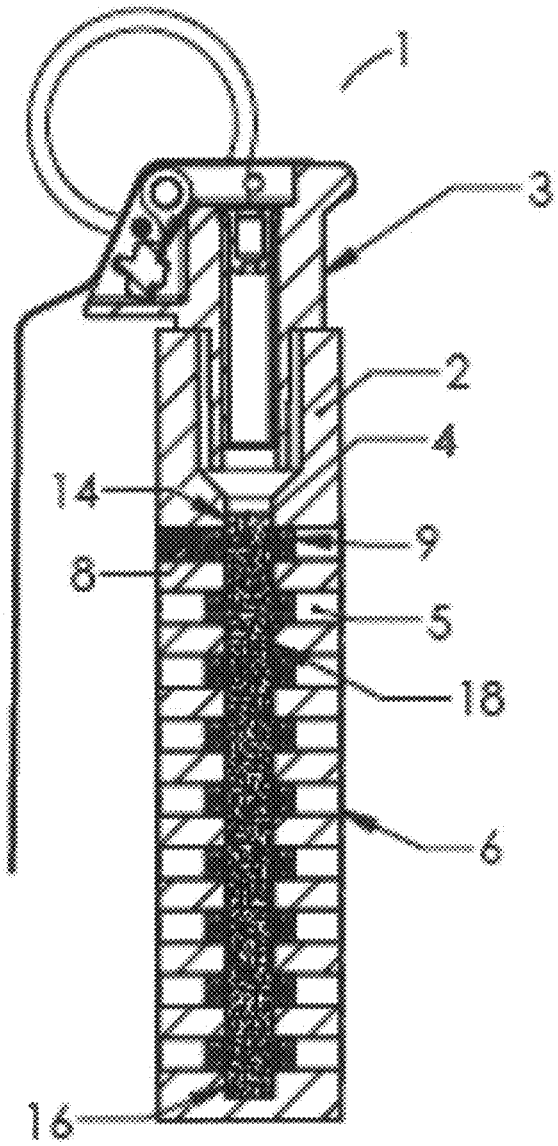
FIG. 1 is a cross sectional view of the multiple output and effect grenade of the present invention.
Figure 2:
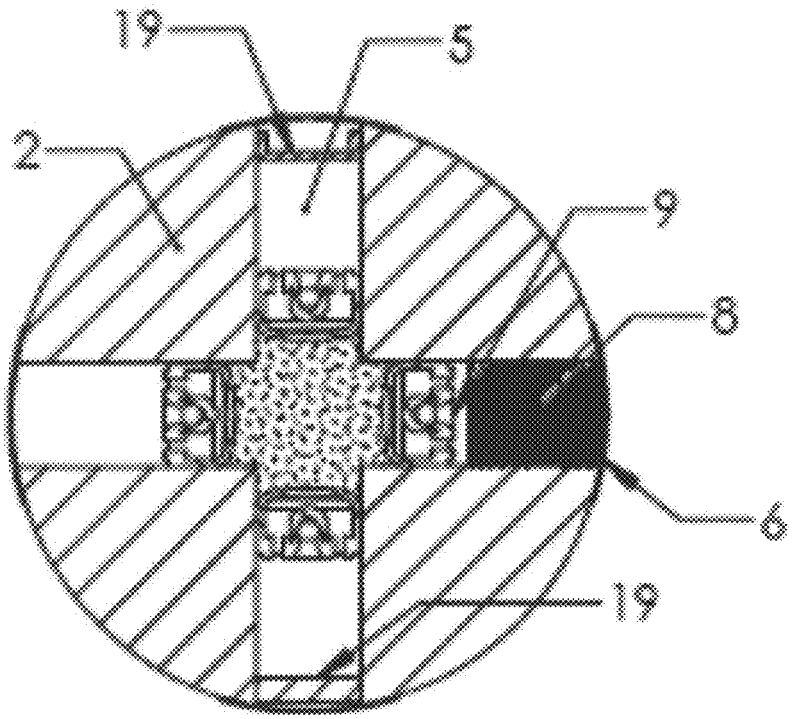
FIG. 2 is a horizontal cross sectional view of the multiple output and effect grenade of the present invention, illustrating the disposition of the primer and effects charge within the primer cavity, the covering material disposed thereover, and the U-formed closure disposed therein.
Figure 3:
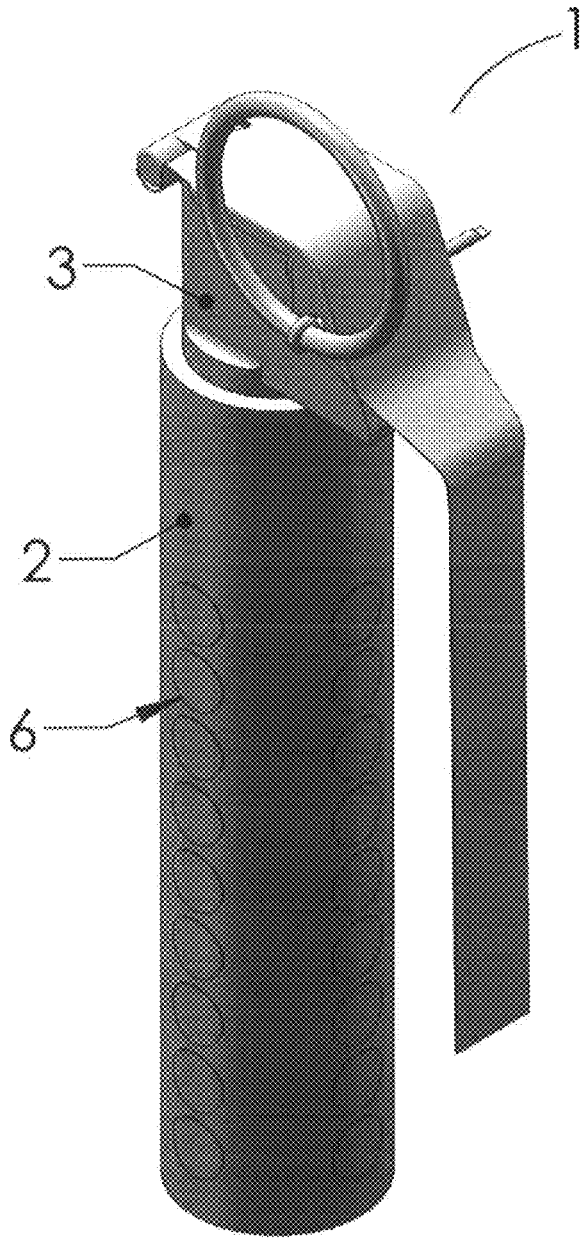
FIG. 3 is a perspective view of the multiple output and effect grenade of the present invention shown in FIGS. 1 and 2.
Figure 4:
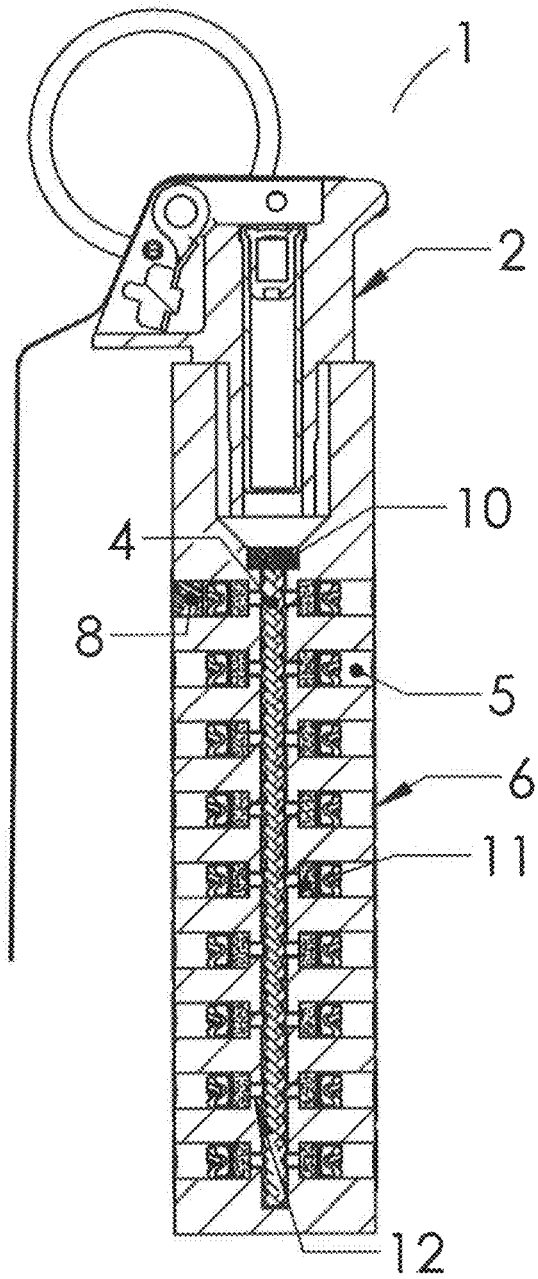
FIG. 4 is a longitudinal cross sectional view of the multiple output and effect grenade of the present invention, illustrating the preferred embodiment wherein the delay column is a fuze cord, and wherein an booster charge is disposed adjacent the primers.
Figure 5:
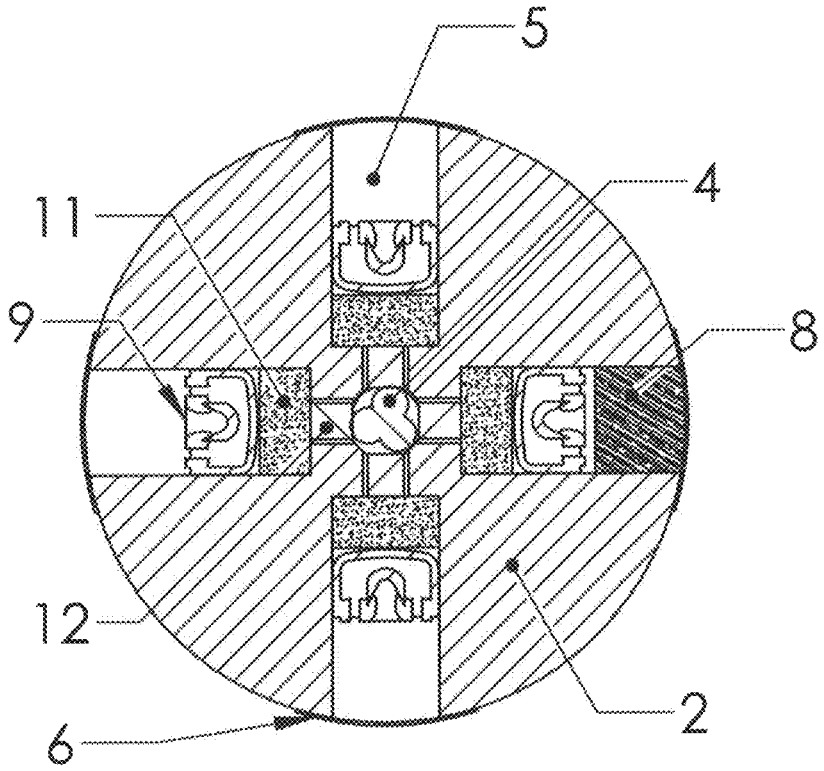
FIG. 5 is horizontal cross sectional view of the multiple output and effect grenade of the present invention shown in FIG. 4.
Figure 6:
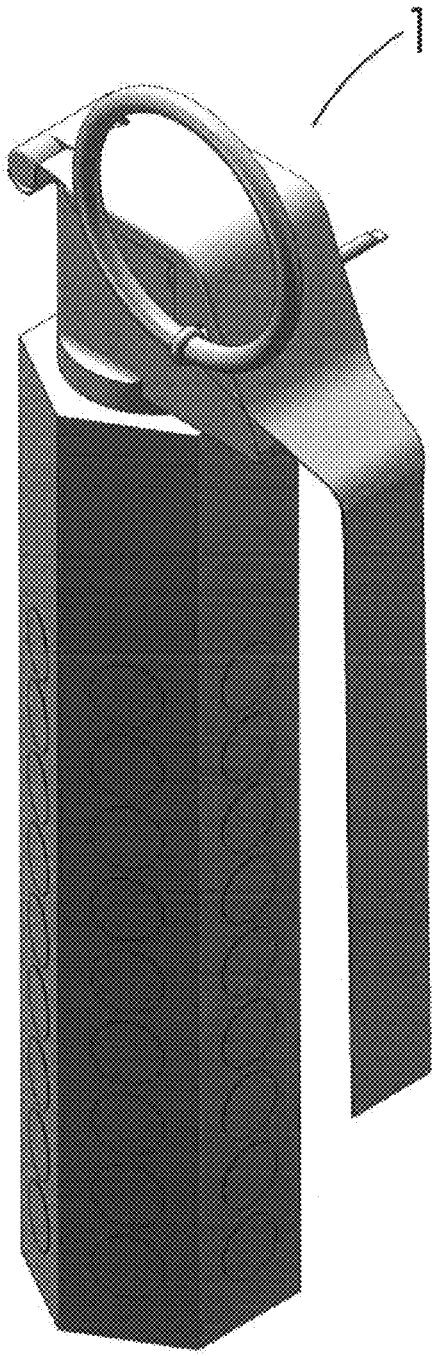
FIG. 6 is a perspective view of the multiple output and effect grenade of the present invention, wherein the main body has a hexagonal shaped outer surface.
Figure 7:
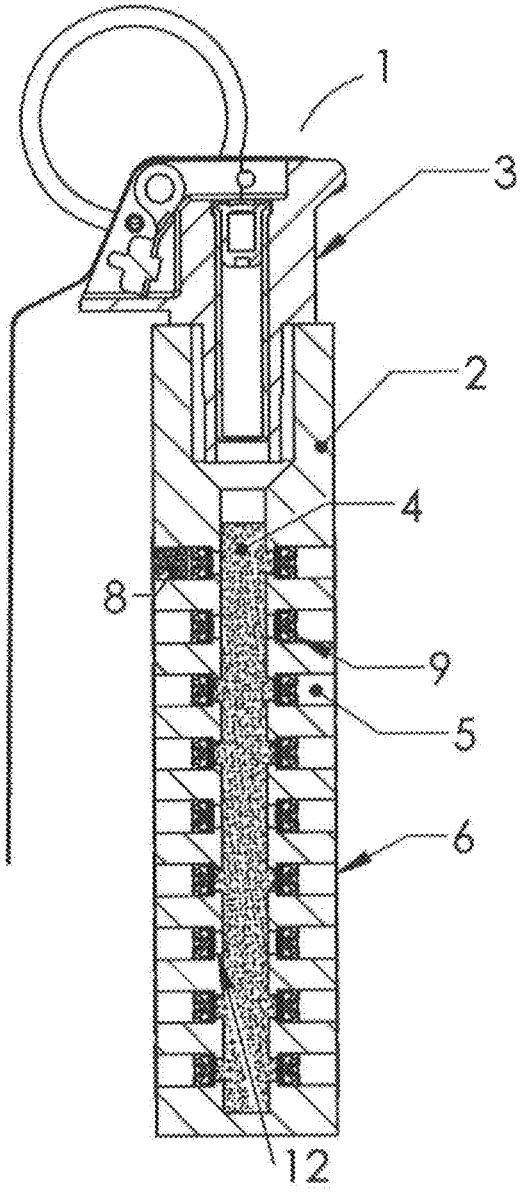
FIG. 7 is a longitudinal cross sectional view of the multiple output and effect grenade of the present invention, as illustrated in FIG. 6.
Figure 8:
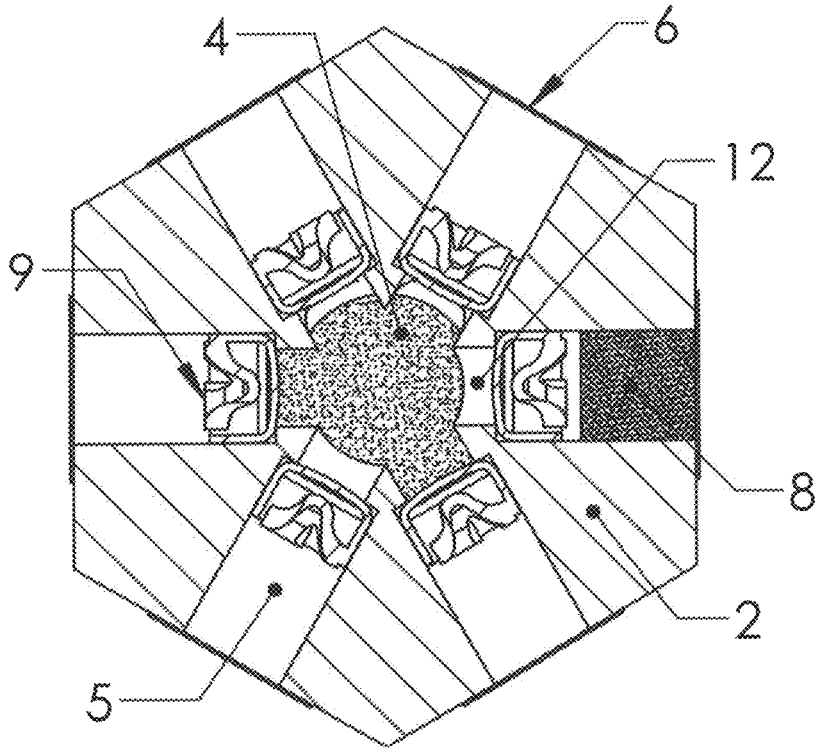
FIG. 8 is a horizontal cross sectional view of the multiple output and effect grenade shown in FIGS. 6 and 7, illustrating the disposition of the combustible composition comprising the delay column, as well as disposition of the transfer cavity relative to the primer.
Figure 9:
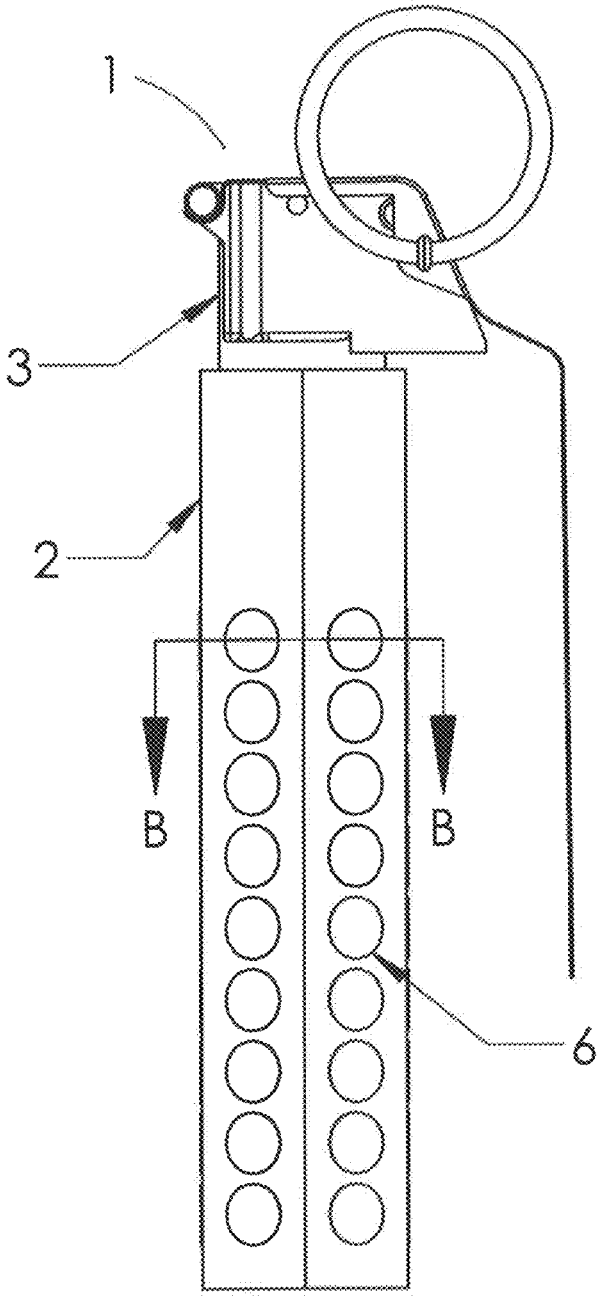
FIG. 9 is a side view of the multiple output and effect grenade of the present invention shown in FIGS. 6-8, illustrating one preferred configuration of the primer cavities, wherein the primer cavities are disposed in a radial, equally spaced pattern relative to the delay column (i.e., the longitudinal axis).

In particular, as illustrated in FIGS. 1-12, the present invention provides a multiple output and effect grenade 1, comprised of a main body 2 having a first end 14, a second end 16 opposite the first end 14, and an outer circumference therebetween. The main body 2 may have a circular outer circumference, as illustrated in FIGS. 2 and 3. Alternatively, the main body 2 may have a multi-surfaced outer circumference, as illustrated in FIGS. 6, 8 and 9. Such a multi-surfaced outer circumference, such as the hexagonal configuration shown in FIG. 6, enables the grenade to maintain a stable disposition on a resting surface when laid on its side. During use, such a characteristic may be preferred, so as to prevent unintended rolling of the grenade.

Figure 10:
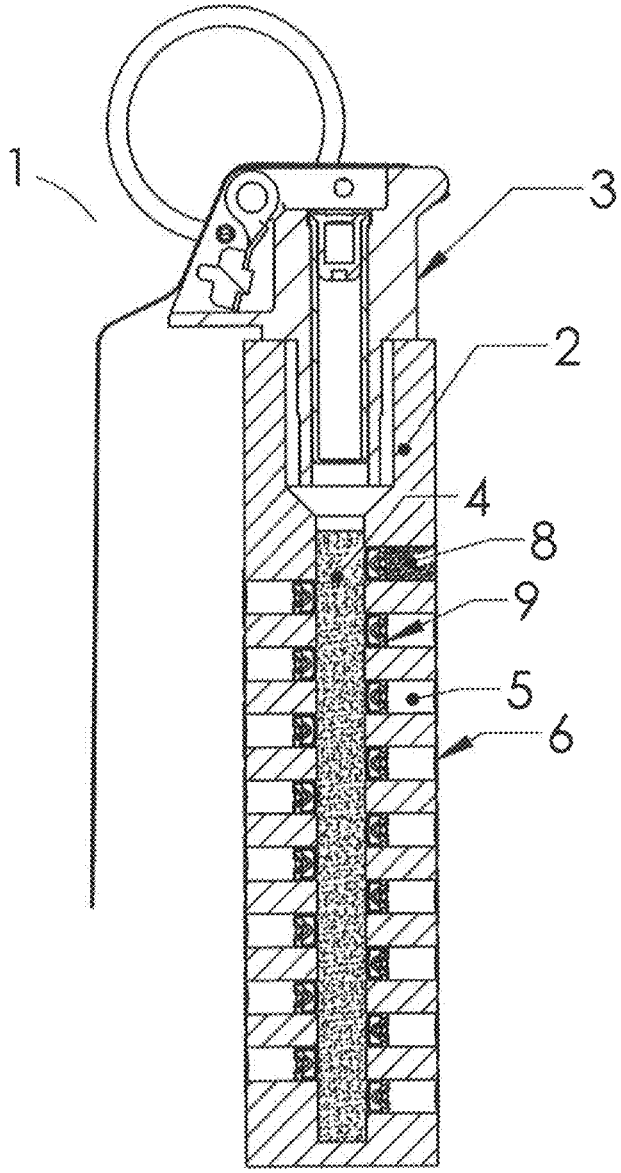
FIG. 10 is a longitudinal cross sectional view of the multiple output and effect grenade of the present invention, wherein the primer cavities are disposed in an asymmetrical helical pattern relative to the delay column.

As illustrated in FIG. 1, a main cavity 18 is disposed within the main body 2 between the first end 14 and the second end 16, the main cavity 18 defining a longitudinal axis. As illustrated in FIGS. 1 and 10, an exothermic delay column 4 is disposed within the main cavity 18, the delay column 4 having a first end, a second end opposite the first end, and a middle portion therebetween. A fuze 3, which may be any conventional type of fuze assembly/mechanism, may also be disposed on or adjacent to the first end of the main body 2 so as to be in communication with the delay column 4, thereby being operable to initiate same. In addition, as illustrated in FIG. 4, an ignition charge 10 may be optionally provided, so as to ensure initiation of the delay column 4 at the first end thereof by the fuze 3, by providing an initiation bridge therebetween.

As illustrated in FIGS. 1, 2, 7, 8, 10 and 11, the delay column 4 may be comprised of one or more combustible compositions operable to burn from about the first end to about the second end of the delay column. Such combustible compositions may be any convention combustible composition operable to burn in a controlled manner. Preferably, the combustible composition(s) making up the delay column is one or more of zirconium-nickel alloy based composition, tungsten based composition, manganese based composition, chromium base composition, boron based composition, barium chromate based composition and/or black powder based composition.

Upon initiation of the delay column 4, the combustible material controllably burns from the first end to the second end of the delay column 4, creating a highly exothermic reaction at the burning surface of the column 4. As the burning surface travels adjacent to the strike face of each of the primers 9, the heat of such exothermic reaction initiates each primer 9 sequentially as the delay column 4 burns to the second end. By varying the composition, density, etc. of the delay column 4, the rate of initiation of the primers 9 can be varied as desired.

Alternatively, in a preferred embodiment as illustrated in FIGS. 4 and 5, the delay column may be comprised of one or more fuze cords. Like the combustible materials described above, the fuze cord functions to create an exothermic reaction operable to initiate the primers 9. However, when using one or more fuze cords as to the delay column 4, it is also preferred to employ a booster charge 11 adjacent to the strike face of the primer 9, so as to ensure that there is sufficient heat produced to initiate the primer 9. Accordingly, the booster charge 11 is comprised of any combustible material operable to produce sufficient heat, such as black powder or A1A gasless ignition composition. In addition, a transfer cavity 12 is preferably disposed between the fuze cord (acting as the delay column 4) and the booster charge 11, so as to provide a means of ensuring that the booster charge does not predetonate, i.e., detonate prior to the initiation thereof by the fuze cord.

As shown in FIGS. 1, 2, 4, 5, 7, 8, 10 and 11, a plurality of primer cavities 5 is disposed within the main body 2, extending from the outer circumference to the main cavity 18 so as to define an internal orifice in communication with the main cavity 18, and an output orifice within the outer circumference of the main body 2. As illustrated in FIGS. 1-9, in a preferred embodiment, the primer cavities 5 are disposed in a symmetrical helical arrangement with relation to the outer circumference of the main body 2. By being arranged in this configuration, during use when the primers (and optionally effects charges) are initiated, a simulated automatic gunfire effect is produced.

Figure 11:
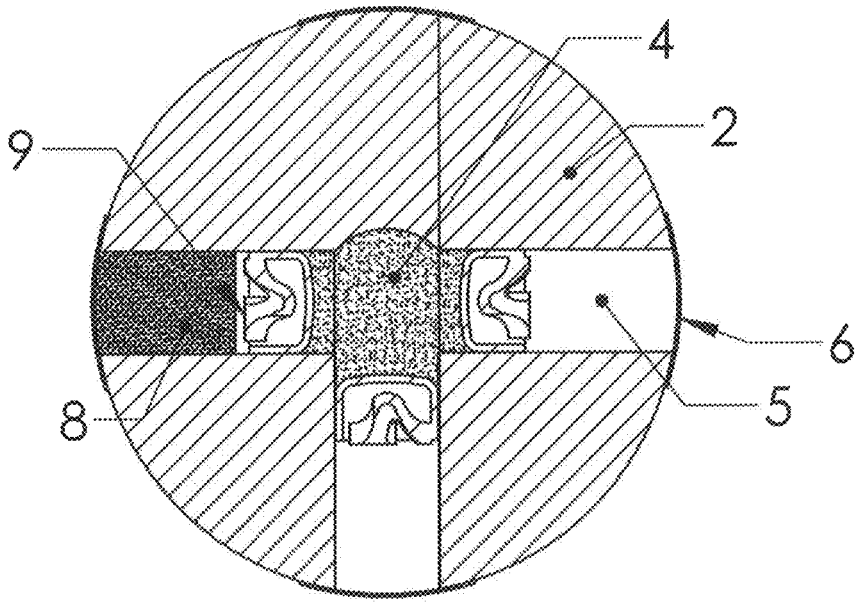
FIG. 11 is a horizontal cross sectional view of the multiple output and effect grenade of the present invention as illustrated in FIG. 10, illustrating the disposition of primer cavities across a level plane when the primer cavities are disposed in an asymmetrical helical pattern relative to the delay column.
Figure 12:
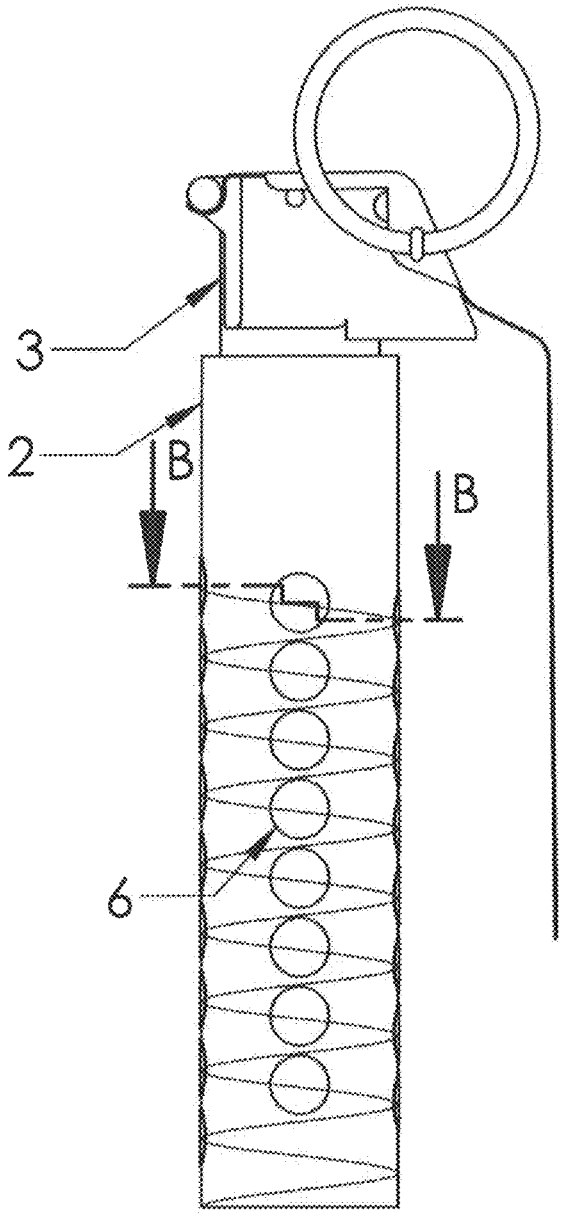
FIG. 12 is a side view of the multiple output and effect grenade of the present invention, illustrating an embodiment wherein the primer cavities are disposed in an asymmetrical helical pattern relative to the longitudinal axis.

Alternatively, in a preferred embodiment as illustrated in FIGS. 10-12, the primer cavities 5 may be disposed in an asymmetrical helical arrangement with relation to the outer circumference of the main body 2. In such an arrangement, during use, a simulated random gunfire effect is produced. Further, different types of effects charges 8 may be disposed in one or more primer cavities 5, so as to produce varying effects at different stages during the combustion/burning of the delay column 4.

As mentioned above, and as illustrated in FIGS. 1, 2, 4, 5, 7, 8, 10 and 11, one or more effect agents 8 are preferably disposed within the primer cavities 5, adjacent the primer 9, such that the effect agents 8 are deployed/initiated via initiation of the primer 9 disposed adjacent thereto. Although these effect agents 8 are not limited to a particular type, such effect agents 8 are preferably selected from illuminant compositions, chemical irritant agents, report (sound) agents, smoke agents and/or marking agents. In a preferred embodiment, the one or more illuminant compositions are selected from the group consisting of magnesium; magnesium powder, sodium nitrate and a binder; magnesium powder, aluminum powder, barium nitrate, strontium nitrate and a binder; aluminum powder, potassium perchlorate and barium nitrate; aluminum powder, barium nitrate and sulfur; magnesium powder, potassium perchlorate, barium nitrate, barium oxalate, calcium oxalate and graphite; magnesium powder, antimony sulfide and potassium perchlorate; black powder, and/or smokeless powder.

In another preferred embodiment, the one or more report (sound) agents are selected from the group consisting of magnesium powder, aluminum powder and potassium perchlorate; aluminum powder and potassium perchlorate; titanium powder and potassium perchlorate (TPP), zirconium powder and potassium perchlorate (ZPP); black powder, and smokeless powder.

In another preferred embodiment, the one or more smoke agents are selected from the group consisting of potassium chlorate, sugar, magnesium carbonate and anthraquinone; potassium chlorate, sugar, green dye (MIL-D-3277), potassium bicarbonate and polyvinyl acetate (PVA); potassium chlorate, sugar, red dye (MIL-D-3284), sodium bicarbonate and PVA; and/or aluminum, hexachloroethane and zinc oxide.

Preferably, the one or more marking agents are selected from the group consisting of direct dyes, azoic dyes, acid dyes, cationic dyes, disperse dyes, vat dyes, reactive dyes, fluorescent dyes, sulfur dyes, infrared dyes, and/or ultraviolet dyes.

Preferably, the one or more chemical irritant agents are selected from the group consisting of CS (o-chlorobenzylidene malononitrile) and OC (oleoresin capsicum).

In a preferred embodiment, as illustrated in FIGS. 1-2, one or more of the primer cavities 5 is sealed by one or more covering materials 6 and/or a U-formed closure 19, which are disposed on the outer circumference of the main body 2 and/or within the primer cavity(s) 5, respectively. These covering materials 6 and/or U-formed closures 19 are operable to secure the primer cavities 5 from the exterior environment, thereby protecting the primers 9 and effect charges 8 during shipping and storage.

The covering materials 6 may be comprised of any suitable material functional to cover the primer cavities 5, and prevent the introduction therein of moisture, particles, etc. In a preferred embodiment, the covering materials are one or more of a polymeric material or rubber material adhesively disposed on/to the outer circumference of the main body 2. Alternatively, the covering material 6 may be a loose plug frictionally engaged with the primer cavity 9, which may be dispelled therefrom by the pressure of the primer initiation/effect charge initiation. The U-formed closure 19 may be a simple disk made of cardboard, plastic or foam, such as styrofoam or similar material, or may be comprised of a thin metal. Additionally, sealing or adhesive compounds may be used to affix the U-formed closure 19 in place and enhance sealing of the primer cavity 5.

The grenade 1 can be configured to provide varying "signatures" by changing the pattern of primer placement, the quantity and type of primers used and the delay characteristics of the delay column. As mentioned above, FIGS. 1-9 illustrate a basic design where 9 (nine) groups of primers 9 are equally spaced apart from each other along the delay column 4. The resulting "signature" would be approximately 9 distinct and equally timed reports, as each group of primers 9 is initiated by the delay column 4. The intensity of the output can be adjusted by increasing or decreasing the amount, as well as type of, primers per group.

A symmetrical helical arrangement of primer cavities 5, as illustrated in FIGS. 1-9, produces a signature simulating automatic gunfire. Alternatively, as illustrated in FIGS. 10-12, an asymmetrical helical arrangement of primer cavities 5 simulates random single shots, and effects if effect charges 8 are disposed in the primer cavities 5. It should be noted that there is no limitation (albeit greater than 2) to the number of primer cavities 5, primers 9 and/or effect charges 8. Rather, these elements are tailored to create the desired effect. For example, the grenade 1 can contain primers, as well as one or more of illuminant compositions, smoke generating compositions, crowd control (chemical irritant agents), etc., depending upon the situation. Further, advantageously, such effect agents 8 can be added into existing grenades 1 in the field, enabling user to tailor the grenade "on the fly".

Although specific embodiments of the present invention have been disclosed herein, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

List of Drawing Elements:

1: multiple output and effect grenade
2: main body
3: fuze
4: delay column
5: primer cavity
6: covering material
8: effects charge
9: primer
10: ignition charge
11: booster charge
12: transfer cavity
14: first end of delay column 4
16: second end of delay column 4
18: main cavity
19: U-formed closure means

What is claimed is:

1. A multiple output and effect grenade, said grenade comprising:

(a) a main body having, an outer circumference, and a main cavity disposed within the main body;

(b) an exothermic delay column disposed within the main cavity;

(c) at least one primer cavity disposed within the main body; and (d) at least one primer disposed within the primer cavity, wherein the exothermic delay column is configured to initiate the primers in a controlled manner via the application of heat thereto.

2. The multiple output and effect grenade of claim 1, wherein the main body has a circular outer circumference or a multi-surfaced outer circumference.

3. The multiple output and effect grenade of claim 1, wherein the delay column is comprised of one or more fuze cords.

4. The multiple output and effect grenade of claim 1, wherein the delay column comprises one or more combustible compositions operable to burn from about a first end to about a second end of the delay column.

5. The multiple output and effect grenade of claim 4, wherein the combustible compositions are one or more of a zirconium-nickel alloy based composition, tungsten-based composition, manganese based composition, chromium base composition, boron based composition, barium chromate based composition and/or black powder based composition.

6. The multiple output flash bang and effect grenade of claim 1, further comprising a fuze disposed on or adjacent to the main body so as to be in communication with the delay column.

7. The multiple output and effect grenade of claim 1, further comprising one or more effect agents selected from illuminant compositions, chemical irritant agents, report (sound) agents, smoke agents and/or marking agents, said effect agents disposed within one or more of the primer cavities, wherein the delay column is operable to initiate the one or more effect agents via initiation of the one or more primers.

8. The multiple output and effect grenade of claim 7, wherein the one or more illuminant compositions are selected from the group consisting of magnesium; magnesium powder, sodium nitrate and a binder; magnesium powder, aluminum powder, barium nitrate, strontium nitrate and a binder; aluminum powder, potassium perchlorate and barium nitrate; aluminum powder, barium nitrate and sulfur; magnesium powder, potassium perchlorate, barium nitrate, barium oxalate, calcium oxalate and graphite: magnesium powder, antimony sulfide and potassium perchlorate; black powder, and smokeless powder.

9. The multiple output and effect grenade of claim 7, wherein the one or more report (sound) agents are selected from the group consisting of magnesium powder, aluminum powder and potassium perchlorate; aluminum powder and potassium perchlorate; titanium powder and potassium perchlorate (TPP), zirconium powder and potassium perchlorate (ZPP); black powder, and/or smokeless powder.

10. The multiple output and effect grenade of claim 7, wherein the one or more smoke agents are selected from the group consisting of potassium chlorate, sugar, magnesium carbonate and anthraquinone; potassium chlorate, sugar, green dye (MIL-D-3277), potassium bicarbonate and polyvinyl acetate (PVA); potassium chlorate, sugar, red dye (MIL-D-3284), sodium bicarbonate and PVA; and aluminum, hexachloroethane and zinc oxide.

11. The multiple output and effect grenade of claim 7, wherein the one or more marking agents are selected from the group consisting of direct dyes, azoic dyes, acid dyes, cationic dyes, disperse dyes, vat dyes, reactive dyes, fluorescent dyes, sulfur dyes, infrared dyes, and/or ultraviolet dyes.

12. The multiple output and effect grenade of claim 7, wherein the one or more chemical irritant agents are selected from the group consisting of CS (o-chlorobenzylidene malononitrile) and OC (oleoresin Capsicum).

13. The multiple output and effect grenade of claim 1, wherein the primer cavities are disposed in a helical arrangement with relation to the outer circumference of the main body, so as to produce a simulated automatic gunfire effect during use.

14. The multiple output and effect grenade of claim 1, wherein the primer cavities are disposed in an asymmetrical helical arrangement with relation to the outer circumference of the main body, so as to produce a simulated random gunfire effect during use.

15. The multiple output and effect grenade of claim 1, further comprising an ignition charge disposed within the main cavity, adjacent a first end of the delay column, said ignition charge operable to ensure ignition of the delay column at or adjacent the first end thereof.

16. The multiple output and effect grenade of claim 15, wherein the ignition charge comprises one or more of black powder; A-1A gasless ignition powder; boron/potassium nitrate; silicon, potassium nitrate, charcoal and nitro cellulose (NC) (commonly known as starter mixture V); and potassium nitrate, charcoal and NC (Starter Mixture XII).

17. The multiple output and effect grenade of claim 1, further comprising a booster charge disposed within the primer cavity, adjacent a strike face of the primers, wherein the booster charge is operable to ensure ignition of the delay column adjacent a first end thereof.

18. The multiple output and effect grenade of claim 1, further comprising a transfer cavity disposed between the main cavity and the primer cavity.

19. The multiple output and effect grenade of claim 1, further comprising one or more covering materials disposed on the outer circumference of the main body, the one or more covering materials operable to secure the primer cavity from the environment.

20. The multiple output and effect grenade of claim 1, further comprising one or more U-formed closure means disposed within one or more of the primer cavities, the one or more U-formed closure means operable to secure the primer cavities from the environment.

* * * * *